United States Patent [19]

Stritzl et al.

[11] Patent Number: 4,867,471

[45] Date of Patent: Sep. 19, 1989

[54] SAFETY BINDING

[75] Inventors: Karl Stritzl, Vienna; Hubert Würthner, Hainburg/Donau; Andreas Riegler, Vienna, all of Austria

[73] Assignee: TMC Corporation, Switzerland

[21] Appl. No.: 149,230

[22] PCT Filed: May 14, 1987

[86] PCT No.: PCT/EP87/00255

§ 371 Date: Dec. 18, 1987

§ 102(e) Date: Dec. 18, 1987

[87] PCT Pub. No.: WO87/07517

PCT Pub. Date: Dec. 17, 1987

[30] Foreign Application Priority Data

Jun. 10, 1986 [AT] Austria ..... 1577/86

[51] Int. Cl.[4] ..... A63C 9/081

[52] U.S. Cl. ..... 280/618; 280/626; 280/628

[58] Field of Search ..... 280/626, 627, 628, 629, 280/618, 617, 632, 636, 631

[56] References Cited

U.S. PATENT DOCUMENTS

| | | | |
|---|---|---|---|
| 3,966,218 | 6/1976 | Beyl | 280/618 |
| 4,294,461 | 10/1981 | Eckart | 280/618 |
| 4,484,764 | 11/1984 | Kirsch | 280/628 |
| 4,531,758 | 7/1985 | Svoboda et al. | 280/628 |

FOREIGN PATENT DOCUMENTS

| | | | |
|---|---|---|---|
| 382084 | 1/1987 | Austria . | |
| 2243642 | 3/1973 | Fed. Rep. of Germany | 280/626 |
| 2510385 | 10/1975 | Fed. Rep. of Germany . | |
| 2849359 | 6/1979 | Fed. Rep. of Germany | 280/618 |
| 2851634 | 6/1980 | Fed. Rep. of Germany . | |
| WO82/02495 | 8/1982 | Fed. Rep. of Germany . | |
| 1579318 | 8/1969 | France | 280/626 |
| 82/02495 | 8/1980 | World Int. Prop. O. . | |

*Primary Examiner*—Charles A. Marmor
*Assistant Examiner*—Tamara L. Finlay
*Attorney, Agent, or Firm*—Finnegan, Henderson, Farabow, Garrett & Dunner

[57] ABSTRACT

The invention concerns a ski safety binding with a sole plate pivoting about a rising pin. The sole plate cannot however be lifted off the ski. The sole plate includes at its rear a heel holder and at its front a toe piece. The sole holder is pivotable about a cross rod at the front. The toe piece includes a control member associated with a control cam of a guide plate. When a pre-determined pivot angle of the sole holder relative to the longitudinal ski axis is reached, the control cam allows the sole holder to pivot to allow the release of the ski boot. In the present invention the front of the sole plate is designed to be a bearing which supports at least one cross bolt which supports the sole holder, the control member and a ratchet lever. Further, at the front of the bearing is an attachment which enters a guide groove located in the guide plate and is moveable in longitudinally displaceable manner on a base plate.

12 Claims, 4 Drawing Sheets

SAFETY BINDING

FIELD OF THE INVENTION

The present invention relates to a safety ski binding having a sole plate pivotally supported on a rising pin fixedly secured to the ski.

BACKGROUND OF THE INVENTION

Applicants' earlier German patent number 382,084 is similar to the present invention and relates to a novel protection against soiling and a simplified toe construction. This patent represents the cutting edge of the safety ski binding art because the sole holder is an independent component and is pivotable about a transverse axis.

In contrast, in German patent 31 02 010 the entire toe piece pivots about a transverse axis.

SUMMARY OF THE INVENTION

An object of the present invention is to overcome the problems and disadvantages of the prior art.

An object of the present invention is to so design a toe piece that is an improvement over the conventional design because it is more compact and the number of individual components are reduced.

Because the control member directly engages the spring load ratchet lever, it is possible to use only one leg spring which simultaneously loads the sole holder mounted on a common cross rod of ratchet lever and control member. Moreover, the control member itself may act as a cover for the ratchet lever and as seen in the travel position for the guide surface and the fore of the sole plate.

The features of the present invention assure reliable guidance between the sole plate and the guide plate in a simple manner. The pivotability of the sole plate is determined in especially simple manner by the features of the invention.

Because of the integral design of guide surface and guide plate according to the invention, the number of components required in this region is reduced separately. The design of the guide plate according to the features of the invention allows to integrate the component used for arbitrary opening into the guide plate.

The compactness of the overall binding is enhanced by the oblique design of the guide surface of the present invention.

The features of the present invention make possible an especially advantageous design of the control beak or member. The features of the invention protect an especially advantageous shape of the control member. Simple and reliable cooperation between the control beak and the control member is defined by the features of the invention.

A design of the sole holder, and its cooperation with the shackle-bolt and the one with the leg spring according to the features of the invention allows special compactness in this region.

Arbitrary opening also of the toe piece is made possible by the features of the invention.

BRIEF DESCRIPTION OF THE DRAWINGS

The accompanying drawings, which are incorporated in and constitute a part of this specification, illustrate several embodiments of the present invention and together with the description, serve to explain the principles of the present invention.

DETAILED DESCRIPTION OF THE PREFERRED EMBODIMENTS

Figure 1:
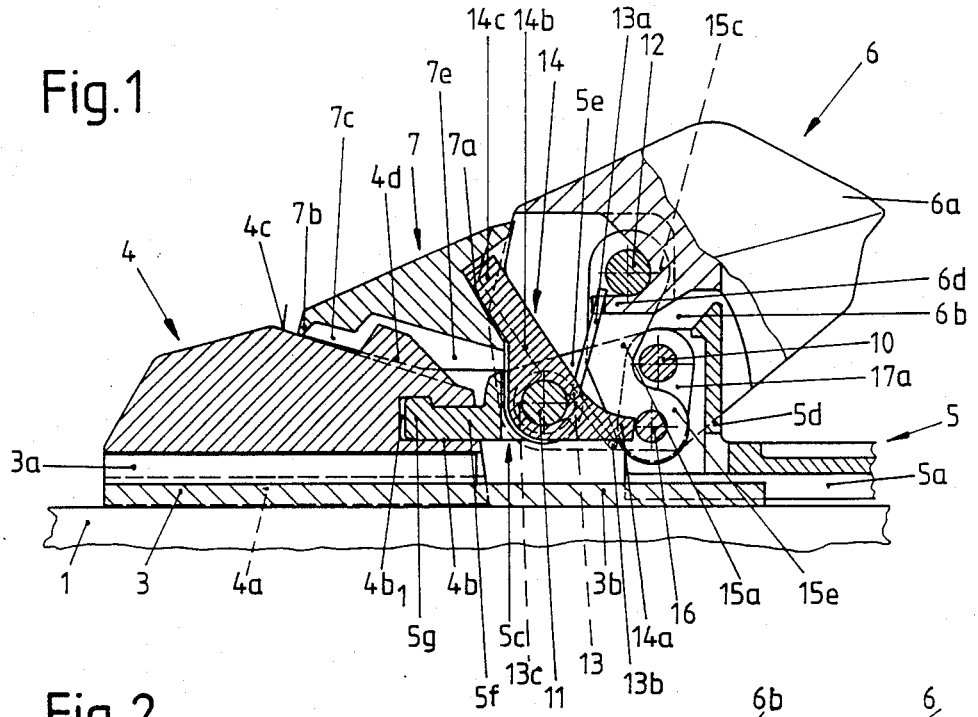
FIG. 1 shows a longitudinal section along line 1—1 of FIG. 2 of the toe piece of the present invention in the travel position.

In the following description, the expressions "front, rear, left, right" refer to the travel position, i.e., "front" means toward the ski tip.

A base plate 3 is mounted by screws 2 on a ski 1. The base plate 3 is equipped on both sides with upwardly positioned guide rails 3*a* that extend in the longitudinal direction of the ski. A tab-shaped attachment 3*b* extends from the base plate 3 and projects rearwardly in the ski axis zone.

A guide plate 4 is supported on the base plate 3 at its foundation 4*a* in a longitudinally displaceable manner, yet cannot be lifted from the ski 1. A guide groove 4*b* parallel to the ski topside and transverse to the ski longitudinal axis is located at the boot side end of the guide plate 4. The guide groove 4*b* is shaped to include at its front end an upwardly widening portion $4b_1$. A guide surface 4*c* which is angled in an oblique downward and rearward manner is present in the topside of the guide plate 4. As shown in FIGS. 4–8, control beak 4*d* including two slopes 4*e*, 4*f* symmetric to the center axis of the control beak 4*d* extends from the longitudinal axis zone of the guide surface 4*c*. The two slopes 4*e*, 4*f* converge upward and each subtend an angle alpha between 15° and 90° with the guide surface 4*c*.

A sole plate 5 is pivotably supported in known manner on a pivot pin. Wedge shaped and rearwardly converging pivot stops 5*a*, 5*b* are provided at the underside of the sole plate 5. The oblique shape of the wedges and the manner of placement allows each pivot stop 5*a* or 5*b* to rest against the longitudinal side of the tab-shaped attachment 3*b* of the base plate. The front end zone of the sole plate 5 when the sole plate is in the swung out position is designed to be a bearing 5*c* for a support bolt 10 and a cross bolt 11. The bearing 5*c* comprises an approximately rectangular clearance 5*e* in its region facing the ski 1 and is bound by a wall 5*d* at its boot-side end. The fore of the bearing 5*c* is in the form of a projection 4*f* and assumes the cross-sectional shape of a prone L. The projection 5*f* of the bearing 5*c* enters the guide groove 4*b* of the guide plate 4, whereby an upward part 5*g* of the projection 5*f* is present in the upwardly widening portion $4b_1$ of the guide grove 4*b*.

A sole holder 6 is pivotably supported by the cross bolt 11. The rear end of sole holder 6 comprises a receiving zone 6*a* for a ski boot. Bearings for the cross bolt 11 and sole holder bolt 12 are provided in side walls 6*b*, 6*c* of the sole holder 6. The sole holder 6 is open at the front. The sole holder 6 includes at least one snap-in site 6*d* for one leg 13*a* of a leg spring 13. The coils 13*c* of the leg spring 13 enclose the cross bolt 11. The leg spring 13 loads the sole holder 6 in its closed position. A second leg 13*b* of the leg spring 13 rests on a first lever arm 14*a* of a two arm ratchet lever 14 and is approximately horizontal in the travel position. The two arm ratchet lever 14 rests on the cross bolt 11 near the longitudinal axis of the sole plate 5. As shown in FIG. 1, the first lever arm 14*a* loads the ratchet lever 14 in counterclockwise manner. The second lever arm 14*b* of the ratchet lever 14 extends in an oblique direction in a forward and upward manner. The front end 14*c* sits on the support surface 7*a* of a control member 7 that hinges on the cross bolt 11. In the travel position, front edge 7*b* of the control member 7 rests on the guide surface 4*c* of the guide plate 4. The side facing the guide plate 4 of the control member 7 comprises a clearance 7*c* which is laterally enclosed by limit walls 7*d*, 7*e*. Limit walls 7*d* and 7*e* extend in an oblique outwardly and downwardly direction and at an angle between 15° and 90° with the sectional plane orthogonal to the guide surface 4*c*.

Two symmetrically mounted, kidney-shaped connecting levers 15*a*, 15*b* are supported at their upper ends on the sole holder bolt 12. The lower ends 15*e*, 15*f* of the connecting levers 15*a*, 15*b* are connected by a shackle bolt 16 with shackles 17*a*, 17*b*. The shackle bolt 16 may be provided with a bush omitted from the drawing. The shackles 17*a*, 17*b* are hinged by means of the support bolt 10 on the bearing 5*c* of the sole plate 5.

Figure 2:
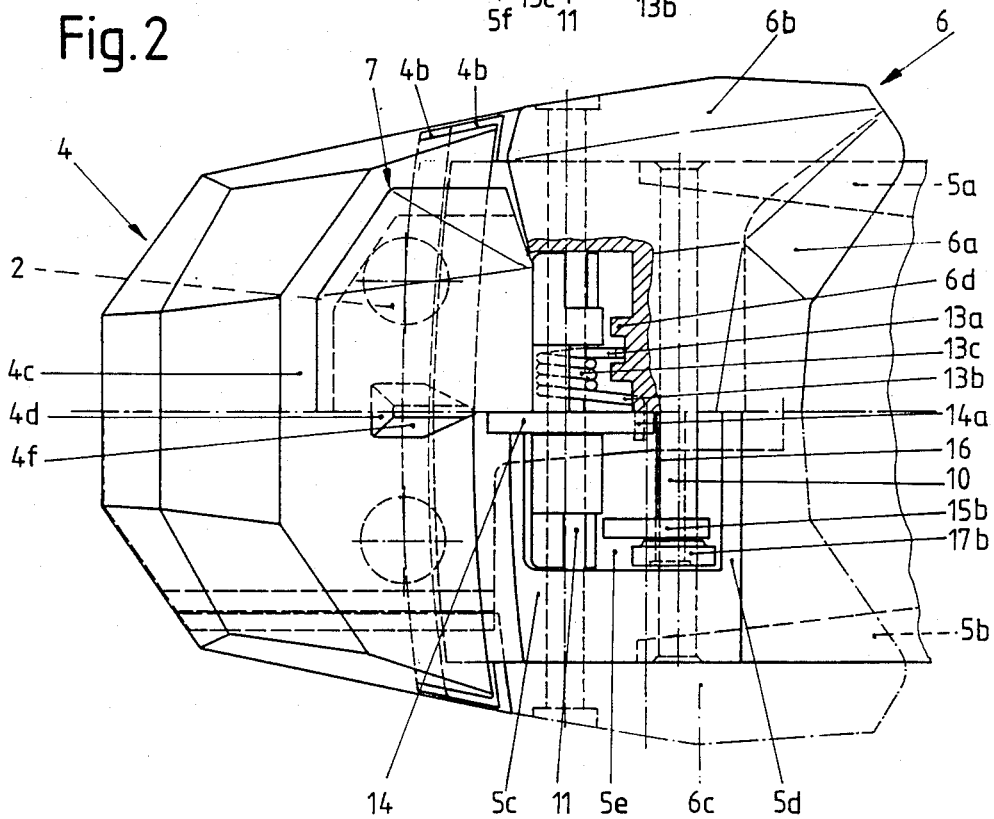
FIG. 2 shows a part sectional top view of the toe piece of the present invention.
Figure 3:
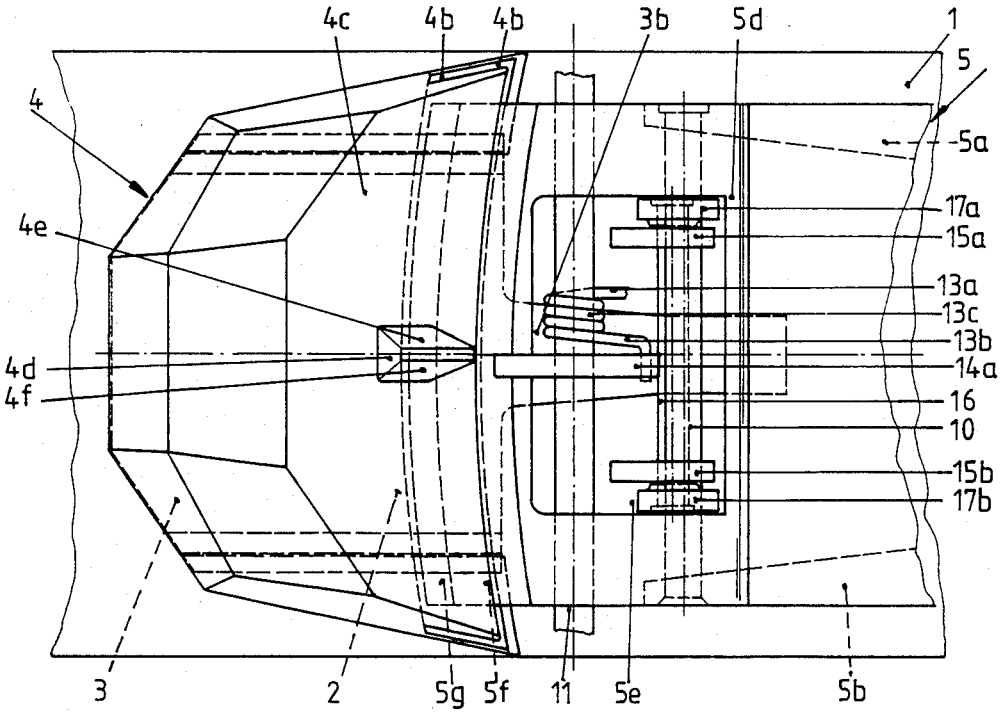
FIG. 3 shows a top view in the travel position with omitted components covering the sole plate.

FIG. 3 shows a ski binding similar to that shown in FIG. 2. Because the sole holder 6 and the control member 7 are omitted in FIG. 3, the support bolt 10, the cross bolt 11, the shackle bolt 16, the ratchet lever 14, the connecting levers 15*a*, 15*b* and the shackles 17*a*, 17*b* can be seen more clearly.

Because of the structure of the present invention when lateral load is applied the sole plate 5 pivots. Consequently, the control member 7 moves along and slides by its front edge 7*b* along the guide surface 4*c* of the guide plate 4. When one of the two oblique limit surfaces 7*d*, 7*e* of the control member 7 arrives at the control beak 4*d*, or begins to exceed it, the control member 7 is pivoted up and drags along the ratchet lever 14 against the force of the leg spring 13. As a result, the shackle bolt 16 is released by the horizontal lever arm 14*a* of the ratchet lever 14. Thereafter, the sole holder 6 under the effect of the boot pivots up. The procedure is described further below in greater detail in relation to FIGS. 6 through 8.

Figure 4:
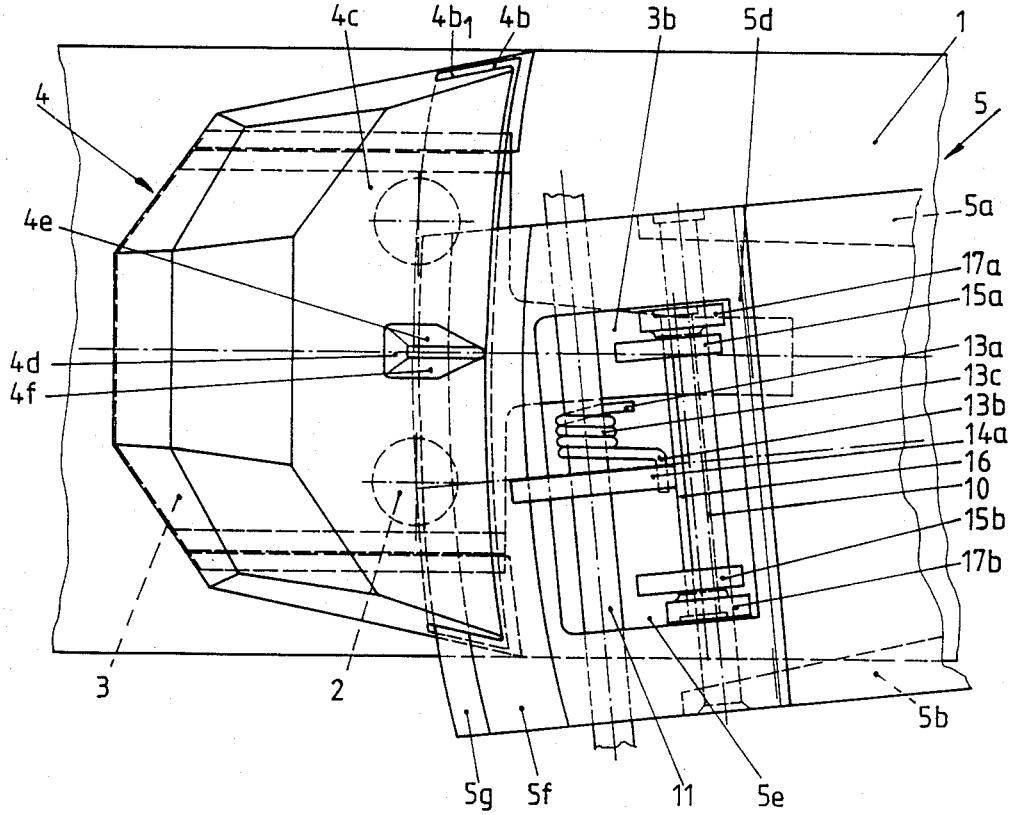
FIG. 4 shows a top view similar to FIG. 3 but with the sole plate having been pivoted.

FIG. 4 shows the swung out condition of the sole plate 5. for greater clarity, the sole holder 6 and the control member 7 are omitted from this Figure. It can be seen that the sole plate 5 has not quite reached its fully swung out position which, in the pivoting direction shown, would be determined by pivot stop 5*a* resting against the tab shaped attachment 3*b* of the base plate 3.

Figure 5:
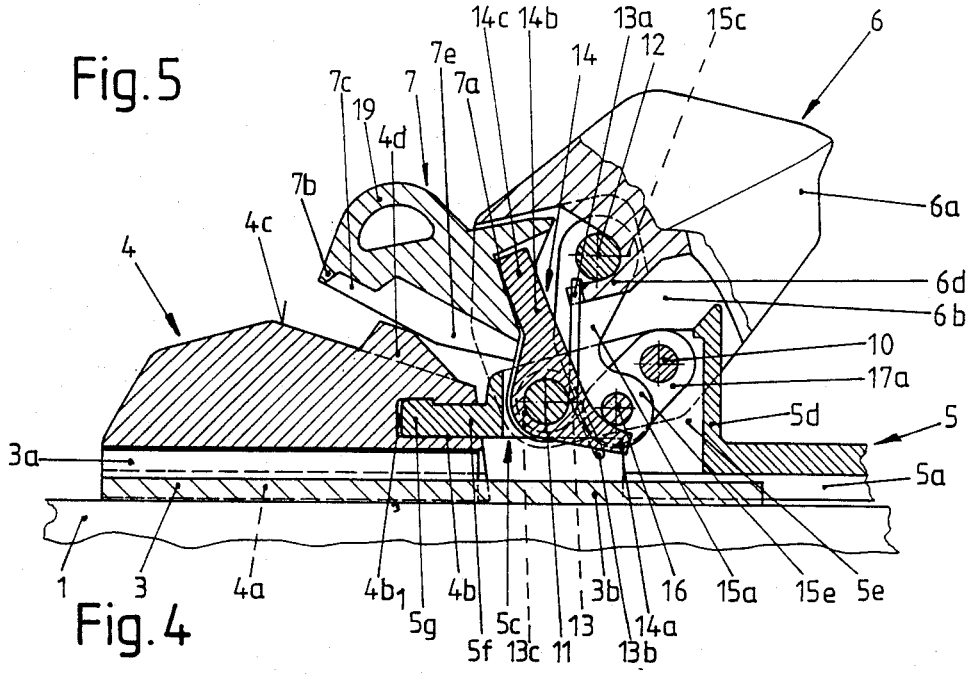
FIG. 5 shows a longitudinal section of the toe piece of the present invention for an arbitrary release.

As a rule, the at-will opening of the entire ski binding takes place in the heel zone. As shown in FIG. 5, in extreme cases arbitrary opening of the toe piece may be made possible with a handle 19 which acts directly on the control member 7. Thus, the control member 7 is pulled up by the handle 19 and the ratchet lever 14 is pivoted against the force of the leg spring 13. As described above, the shackle bolt 16 is then released thereby and the sole holder 6 is pivoted up by the boot.

Figure 6:
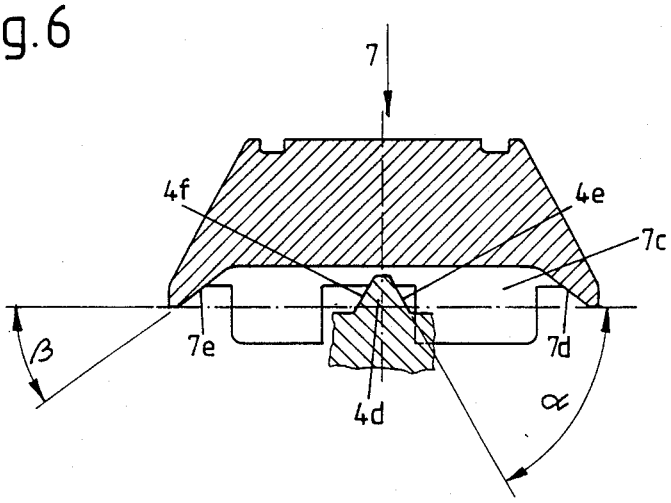
FIGS. 6 through 8 show details of the ski binding of the present invention.
Figure 7:
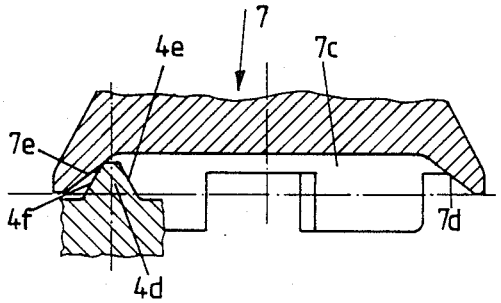
Figure 8:
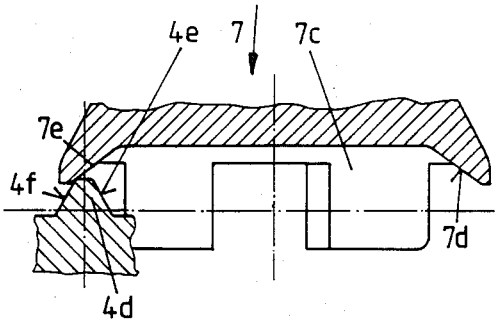

FIGS. 6 through 8 show the cooperation between the control beak 4*d* of the guide plate 4 and the control member 7 and its slanted limit walls 7*e*, 7*d*. As shown in FIG. 6, in the travel position the control member 7 is at its center position. After moving through a certain pivot angle of the sole plate 5, which is a function of boot length, one of the two oblique limit walls 7*e*, 7*d*, in the case shown this is the left limit wall 7*e*, arrives at the control beak 4*d* (FIG. 7). As shown in FIG. 8, as the sole plate 5 pivots further, the control member 7 is forced up against the force of the leg spring 13, and the oblique limit wall 7*e* slides up the slope 4*f* of the control beak 4*d*. The different magnitudes of the angles alpha and beta ensure that jamming between the control beak 4*d* and the control member 7 is reliably averted. It must be borne in mind in this respect that the avoidance of jamming the control member 7 on the control beak 4*d* requires $\alpha \neq \beta$. Where $\alpha$ and $\beta$ are first and second angles, respectively. As shown in FIG. 6, the first angle is greater than the second angle, whereby the limit walls 7*d*, 7*e* cover the control beak 4*d* like a roof.

Figure 9:
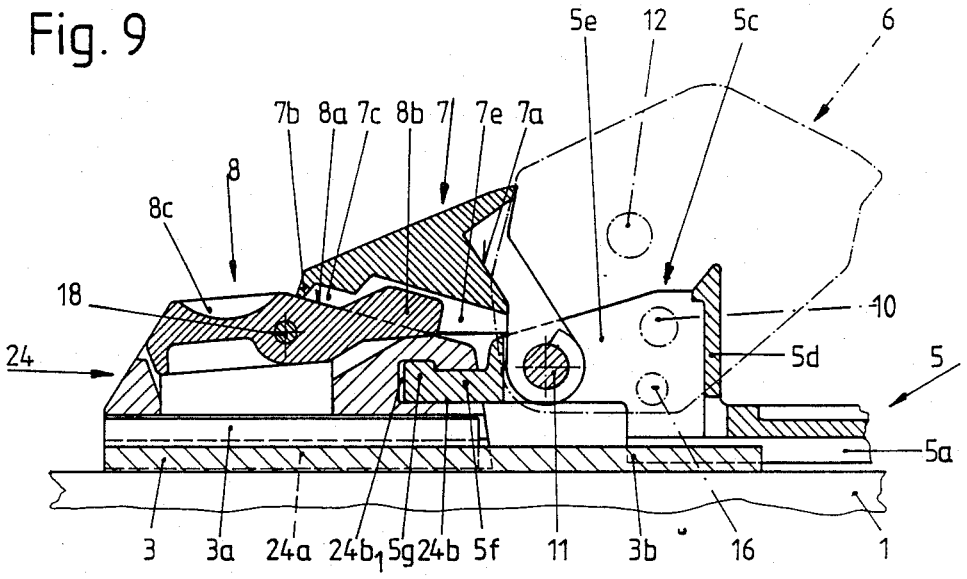
FIG. 9 shows a longitudinal sectional of a second embodiment of the ski binding of the present invention.

FIG. 9 shows a second embodiment of the ski binding of the present invention. The guide plate 24 is designed in such a manner that the at will release of the toe piece is possible in an especially simple manner. Specifically, key 8 is pivotably supported in the guide plate 24 about a cross rod 18. The key 8 is provided at its top side with a guide surface 8*a* and a control beak 8*b* which are shaped like the respective guide surface 4*c* and control beak 4*d* of the first embodiment of FIGS. 1 through 8. At the fronft, the key 8 comprises a depression 8*c* in its top side to receive the tip of a ski stick or a finger. The guide plate 24 comprises a clearance to pivot the key 8. If now the ski stick is pressed into the depression 8*c* of the key 8, the key 8 will swing up about the cross rod 18, and the control beak 8*b* will force the control member 7 upwardly. The remainder of the binding is of the same design as in the first embodiment and therefore is not further described.

The invention is not bound to the two embodiments shown in the drawing and described above. Rather several variations are possible without transcending the scope of the invention. Illustratively two symmetrically mounted leg springs might be used in lieu of one, or a symmetrically mounted spring might be integral. As already mentioned, the shackle bolt 16 may be provided with a bush that would lower the friction forces. This also would reduce the friction occurring during binding actuation. Furthermore, the angle alpha may be less than the angle beta, in which case the control beak 4*d* would have slopes 4*e*, 4*f* of a small angle $\alpha$, for instance 30°, and the control member 7 would have limit walls 7*d*, 7*e* with a large angle $\beta$ for instance 80°. Thereby the limit walls 7*d*, 7*e* of the control member 7 overlap—again in inventive manner—the control beak 4*d* which in this case is provided with slopes 4*e*, 4*f* resembling a high roof.

Other embodiments of the present invention will be apparent to those skilled in the art from consideration of the specification and practice of the disclosed invention. It is intended that the specification and examples be considered as exemplary only, with the true scope and spirit of the invention being represented by the following claims.

What is claimed is:

1. A safety ski binding having a sole plate pivotably supported on a rising pin affixed to the ski, the sole plate being secured against lifting off from the ski and being guided in a guide plate supported on the ski, the safety ski binding further including at its rear end a heel holder and at its front end a toe piece, the toe piece including a sole holder pivotable about a first cross bolt and a control member associated with a control cam of the guide plate, the control cam allowing the sole holder to pivot in the release direction of the ski boot when a predetermined pivot angle of the sole plate relative to the longitudinal ski direction has been reached, comprising:

the front of the sole plate is designed as a bearing for a support bolt having two shackles and the first cross bolt, the first cross bolt acts as a cross-axle for supporting the control member and a ratchet lever having a first and second lever arm;

the front of said bearing including a projection for entering a guide groove of the guide plate;

the guide plate having a foundation longitudinally displaceable along a base plate mounted on the ski and secured from lifting off said base plate;

said guide plate having a top side including a guide surface having a longitudinal axis and provided with a control beak along said longitudinal axis that acts as a control cam for the control member;

wherein said ratchet lever pivotally engages the first cross bolt; and said ratchet is loaded by at least one leg spring that is preferably wound around the first cross bolt;

in a skiing position said first lever arm of said ratchet lever engages a shackle bolt supported by said two shackles and linked by a connecting lever to the sole holder;

one leg of said leg spring abuts said first lever arm of said ratchet lever and biases said ratchet lever against the control member thereby causing the control member to pivot away from the release direction to secure the ski boot on the ski binding; and, the control member is located substantially above and covers said ratchet lever and, in the skiing position, the control member is placed to cover said guide surface of said guide plate and the front of the sole plate.

2. A safety ski binding as defined in claim 1, wherein:

said attachment of said bearing when seen in cross-section essentially assumes an L-shape, and has an upward part extending into a widening portion of said guide groove.

3. A safety ski binding as defined in claim 1, wherein:

the sole plate is provided at its underside with wedge shaped pivot stops converging rearward and functioning as a means for determining the lateral pivoting range of the sole plate by cooperating with a tab-shaped attachment of said base plate.

4. A safety binding as defined in claim 1, wherein:

said guide surface is integral with the guide plate.

5. A ski binding as defined in claim 1, further comprising:

a second cross bolt passing through said guide plate, a key having a guide surface and having a depression region for manual actuation upon application of pressure;

said control beak being pivotally supported on said second cross bolt; and, said guide plate including a clearance for receiving said key.

6. A ski binding as defined in claims 1, 4 or 5, wherein:

said guide surface is positioned in a downward and rearwardly oblique direction.

7. A ski binding as defined in claim 1, wherein:

said control beak of the guide plate having a center axis is formed with two surfaces having two slopes respectively; said two surfaces being symmetric relative to said center axis of said control beak and converging upwardly toward one another at a first angle between 15° and 90° measured from an axis drawn perpendicular to said center axis to one of said two slopes of said control beak.

8. A ski binding as defined in one of claims 1, 5, or 7 wherein:

the control member includes a front edge which in the skiing position, rests on said guide surface of the guide plate;

the control member includes a rear end having a support surface and said second lever arm includes a front end, wherein said second lever arm is supported on said support surface; and, the control member includes a clearance facing the guide plate.

9. A ski binding as defined in claim 8, wherein:

said clearance of the control member is constructed from limit walls; and, said limit walls subtend a second angle between 15° and 90° in a sectional plane orthogonal to said guide surface of the guide plate and transverse to the longitudinal ski direction.

10. A ski binding as defined in claim 9, wherein:

said first angle of said two slopes of said control beak is distinct from said control angle of said limit walls of the control member, and preferably said first angle is greater than said second angle.

the control member is located substantially above and covers said ratchet lever and, in the skiing position, the control member is placed to cover said guide surface of said guide plate and the front of the sole plate.

11. A ski binding as defined in claim 1, wherein:

the sole holder having side walls includes bearings for the first cross bolt;

the sole holder penetrates said side walls and said connecting levers each include upper and lower ends and a kidney-shaped area supported at said upper end by a first sole holder bolt extending therethrough said lower ends of said connecting levers connected to said shackle bolt hingeable connected to the sole plate; and the sole holder is provided with at least one snap in region for receiving one of the legs of said leg spring.

12. A ski binding as defined in claims 1 or 4 comprising:

a handle provided on the control member for at will opening of the binding.

* * * * *

UNITED STATES PATENT AND TRADEMARK OFFICE

CERTIFICATE OF CORRECTION

PATENT NO. : 4,867,471

DATED : September 19, 1989

INVENTOR(S) : Karl Stritzl, et al

It is certified that error appears in the above-identified patent and that said Letters Patent is hereby corrected as shown below:

Claim 10, column 6, line 38: "control" should be --second--; and

Claim 10, column 6, lines 41-45 should be deleted.

Signed and Sealed this

Fourth Day of September, 1990

*Attest:*

HARRY F. MANBECK, JR.

*Attesting Officer*

*Commissioner of Patents and Trademarks*